US006854888B1

(12) United States Patent
Brown et al.

(10) Patent No.: US 6,854,888 B1
(45) Date of Patent: Feb. 15, 2005

(54) MULTISPOUT FLASK WITH PUMP

(76) Inventors: Dennis B. Brown, 343 West 400 North, Logan, UT (US) 84312; Breon J. Robertson, 435 Blvd., Logan, UT (US) 84321

( * ) Notice: Subject to any disclaimer, the term of this patent is extended or adjusted under 35 U.S.C. 154(b) by 57 days.

(21) Appl. No.: 09/871,358

(22) Filed: May 31, 2001

Related U.S. Application Data

(63) Continuation of application No. 09/770,921, filed on Jan. 26, 2001, now abandoned.
(60) Provisional application No. 60/178,802, filed on Jan. 28, 2000.

(51) Int. Cl.[7] ..... B65D 33/16
(52) U.S. Cl. ..... 383/80; 383/41; 383/66; 383/906; 222/107; 222/130; 222/485
(58) Field of Search ..... 383/41, 66, 80, 383/104, 901, 906; 222/105, 107, 130, 482, 485

(56) References Cited

U.S. PATENT DOCUMENTS

| | | | | |
|---|---|---|---|---|
| 2,781,312 | A | 2/1957 | Klumb et al. | |
| 3,304,977 | A | 2/1967 | Hammons | |
| 3,449,081 | A | 6/1969 | Hughes | |
| D236,386 | S | 8/1975 | Katzman | |
| D237,018 | S | 9/1975 | Betka et al. | |
| 3,980,222 | A | 9/1976 | Hood | |
| 4,010,786 | A | 3/1977 | Aguettant et al. | |
| 4,068,696 | A * | 1/1978 | Winchell | 604/404 |
| 4,240,482 | A * | 12/1980 | Andersson et al. | 222/564 |
| D262,056 | S | 11/1981 | Rosemeier et al. | |
| D263,870 | S | 4/1982 | Greene | |
| D271,805 | S | 12/1983 | Larkin et al. | |
| 4,420,097 | A * | 12/1983 | Motsenbocker | 222/131 |
| 4,561,110 | A | 12/1985 | Herbert | |
| 4,588,554 | A | 5/1986 | Kaartinen et al. | |
| 4,614,267 | A * | 9/1986 | Larkin | 206/221 |
| 4,732,299 | A | 3/1988 | Hoyt | |
| D298,567 | S | 11/1988 | Morris | |
| 4,872,766 | A | 10/1989 | Dancy | |
| D304,546 | S | 11/1989 | Cattach | |
| 4,903,718 | A * | 2/1990 | Sullivan | 134/184 |
| 5,085,349 | A * | 2/1992 | Fawcett | 222/175 |
| 5,088,994 | A | 2/1992 | Porat et al. | |
| 5,104,016 | A | 4/1992 | Runkel | |
| 5,115,947 | A * | 5/1992 | McDonnell et al. | 222/107 |
| 5,125,919 | A | 6/1992 | Miller et al. | |
| 5,259,844 | A | 11/1993 | Bilstad et al. | |
| 5,261,532 | A | 11/1993 | Fauci | |
| 5,273,650 | A | 12/1993 | Vermes et al. | |
| 5,282,557 | A * | 2/1994 | McCook | 224/148.2 |
| D396,630 | S | 8/1998 | Lerner | |
| 5,806,726 | A | 9/1998 | Ho | |
| 5,860,571 | A | 1/1999 | Gueret | |
| 5,910,138 | A * | 6/1999 | Sperko et al. | 604/408 |
| 5,913,456 | A | 6/1999 | Dikeman | |
| 6,039,305 | A | 3/2000 | Hoskins et al. | |
| 6,076,967 | A * | 6/2000 | Beaudette | 383/41 |
| 6,176,394 | B1 * | 1/2001 | Shimko et al. | 222/92 |
| 6,497,348 | B2 * | 12/2002 | Forsman et al. | 224/148.2 |

FOREIGN PATENT DOCUMENTS

AU 0168167 * 11/1956

OTHER PUBLICATIONS

Facsimile dated Jul. 29, 1997 entitled TFO Product Sheet.

* cited by examiner

*Primary Examiner*—Jes F. Pascua
(74) *Attorney, Agent, or Firm*—Holme Roberts & Owen LLP

(57) ABSTRACT

A flask is formed of two panels heat sealed together along with a base or bottom insert. Two spouts are provided proximate the top one of which is for the extraction of fluids and the other of which is for the introduction of fluids. The flask may have a bite valve or a fluid conduit attached to one spout cap. Both spouts may be sealed into and along the edge of the flask. Alternately, one spout may be formed into a panel and the other into and along the edge of the flask. Alternately a pump may be provided to pump air into the flask to pressurize the fluid so that it will be urged out of the flask and through the bite valve when it is open.

21 Claims, 13 Drawing Sheets

MULTISPOUT FLASK WITH PUMP

This application is a continuation of U.S. application Ser. No. 09/770,921, filed January 26, 2001, now abandoned, which claims priority from provisional application 60/178,802 filed Jan. 28, 2000.

BACKGROUND

Field: This invention relates to portable fluid carrying bottles or flasks used to carry liquids and more specifically to flexible bottles or flasks that are suitable for attachment to the person for carrying liquids including drinking liquids, beverages and soup-like foods and even more specifically to flexible flasks that have an associated pump for urging fluids therefrom.

State of the Art: Many different styles and types of bottles or flasks are available to transport fluids and, more specifically, liquids such as water or some other similar liquid as well as foods like soups, beverages and the like. Solid insulated bottles or containers typically have some form of glass or glasslike container within a housing and as a result are not flexible and may be regarded as heavy. Such solid insulated bottles or containers are generally viewed to not be well suited for use by cyclists, hikers, cross country skiers and others who are involved in similar outdoor activity and who are transporting fluids on their person directly or by attachment to some other structure being carried or moved by them Some plastic bottles are solid but flexible so they can be squeezed by the hand of the user to urge fluids out. Some versions have a push-pull valve for insertion into the mouth so that a user may suck out the fluid while squeezing the bottle to urge the fluid outward. Other versions have tubes that may be inserted into the mouth and allow for sucking while squeezing the bottle to obtain the liquids. Yet other bottles or flasks are configured to be pressurized with air to urge the fluid out of the bottle or flasks.

Flasks made of opposing plastic panels sealed together along their perimeters are also known. They may be placed inside of an insulating device such as a neoprene bag or a bag made of other similar insulating material. The bags may be attached to the belt, to other structures such as a backpack frame or a bicycle frame or to the person proximate an arm. The user may operate the flask by removing a cap from the spout and drinking. Alternately, the cap may be configured to contain a bite valve such as that disclosed in U.S. Pat. No. 5,971,357 (Denton, et al.). Other arrangements allow for the user to have a tube extend from the flask to a desired location where it may be accessed easily. Yet other arrangements are known in which a periodic or mechanical pumping action is available to urge the liquid out of the flask. For example, a flask can be placed between the upper arm and torso so that the user can effect a pumping action by drawing his or her arm towards the torso in a periodic fashion.

Flasks including those which are rigid and squeezable as well as those made from opposing plastic panels may be placed in an insulating material such as a neoprene jacket, pocket or container to retain the liquids in the flask at a desired temperature. In many uses, cold liquids are desired. To cool liquids, it is sometimes desired to place ice cubes into the flask to act as a coolant. To place ice cubes into the flask, at least some cubes need to be broken in order to fit down or through the spout. Further, to insert the ice as well as the fluid itself, the cap must be removed including the drinking mechanism or arrangement such as a bite valve or a tube. In removing the cap and/or the drinking mechanism, the user may wish to place the cap and/or the drinking mechanism on a nearby surface so that both hands are free to effect the introduction of the liquid and any associated ice. As a result, the user exposes the drinking mechanism to contamination from nearby surfaces and also runs the risk of knocking the cap and/or the drinking mechanism onto the ground or floor. Should the user be out of doors, the result may be extensive contamination. Of course contamination means that a user should undertake to clean whatever is contaminated. Since effective cleaning requires soap or a germicide of some type, it can be seen that cleaning can be quite inconvenient in many situations such as when one is camping.

Of course it is also known that some may want to introduce solids other than ice into a flask. For example, some users may seek to introduce soups having solids or freeze-dried foods for reconstitution. For such items, it can be seen that the user must again remove the cap and any drinking mechanism and thereby run the risk of contamination particularly because drinking mechanisms are not suitable candidates for a cap string or line to hold the cap attached to the flask.

Some flasks or bottles are constructed to be squeezable so that a pressure can be exerted on the fluids to force them out of the flask or bottle. Of course, a user must use his or her hand to squeeze the flask or bottle while typically positioning a spout in the user's mouth. Thus the user must free up a hand when the time to do so may be inconvenient if not risky. Systems that are hands free or that may be used in a way to pressurize the flask intermittently without manipulation of the container itself are not presently known.

As a result there is a need for a flask that permits the user to insert solids with a drinking mechanism attached. There is also a need for a flask that permits the user to pressurize the flask separately or at the same time fluid is being extracted.

SUMMARY OF THE INVENTION

A portable flask has a first panel and a second panel both of which have a top, a bottom and a perimeter. Both panels are formed of a flexible liquid retaining material and sized to be sealed together about their perimeters to define a liquid retaining volume. The flask has a first spout and a second spout both sealed into the perimeter.

The first spout and the second spouts are both positioned proximate the respective tops of the panels. The panels and the flask as formed have a right side and a left side which extend between the top and the bottom. The top has a left section extending angularly away from the left side and a right section extending angularly away from the right side with a middle section between the left section and the right section. The first spout is positioned between the two panels along the perimeter of the flask in the right section. The second spout may be positioned proximate the top in one of the two panels; or the first spout may be positioned in the second section between the two panels along the flask perimeter. One of the first spout and the second spout is configured to have a drinking mechanism associated therewith; and the other of the two spouts is configured to receive solids and liquids therethrough.

A third panel may be attached to extend between the panels at their respective bottoms. The third panel is sealed to the panels at their bottoms and upward therefrom along their sides a distance of about half the total distance of the third panel when fully extended between the first and second panels.

Preferably the first spout is positioned proximate the first top; and the second spout is positioned proximate one of the first top and the second top but spaced from the first spout.

More preferably the first panel has a first right side and a first left side spaced from the first right side. The first right side and the first left side each extend between the top and the bottom; the second panel also has a first right side and a second left side spaced from the second right side. The second right side and the said second left side each extend between the top and the bottom.

Even more preferably, the first top has a left section extending angularly away from the first left side and a right section extending angularly away from the first right side and a middle section between the left section and the right section. The second top has a left section extending angularly away from the second left side and a right section extending angularly away from the second right side and a middle section between the left section and the right section.

Desirably the first spout is positioned in the perimeter between the first panel and the second panel in the first section of each of the first top and the second top. Similarly, the second spout is positioned in the perimeter between the first panel and second panel in the second section of each of the first top and the second top.

The middle section of the first panel and the second panel has a first leg extending from the first spout to an apex and a second leg extending from the apex to the second spout. The first leg and the second leg are each sized in length for effecting a stable seal along the perimeter between the apex and the first spout and the second spout respectively. Preferably the apex is arcuate with a radius less than the length of one of the first leg and the second leg. The perimeter seal is most preferably a flat seal having a depth which may extend from about one fourth of an inch to about one inch.

In a preferred arrangement the first base has a first outer surface and a second outer surface spaced from each other with the first aperture positioned between. The first outer surface and the second outer surface are each configured to be sealed into the perimeter seal between the first perimeter of the first panel and the second perimeter of the second panel proximate the first top of the first panel and the second top of the second panel.

The second base has a third outer surface and a fourth outer surface spaced from each other with the second aperture positioned thereinbetween. The third outer surface and the fourth outer surface are each configured to be sealed into the perimeter seal between the first perimeter of said first panel and the second perimeter of the second panel proximate the first top of the first panel and the second top of the second panel.

The first base has a first edge and a second edge with the aperture thereinbetween, with the first outer surface and the second outer surface extend arcuately between the first edge and the second edge. Similarly, the second base has a third edge and a fourth edge with the aperture thereinbetween. The third outer surface and the fourth outer surface extend arcuately between the third edge and the fourth edge.

In a desired configuration, the portable flask further includes a first cap sized and configured for removable attachment to the first spout to seal the contents of the flask therein and a second cap sized and configured for removable attachment to the second spout to also seal the contents of the flask therein.

In another desired configuration, the portable flask of the invention has a third panel made of liquid retaining material. The third panel is sized to attach to and extend between the first bottom and the second bottom. The third panel is sealed to the first panel and the second panel at the first bottom and the second bottom and upwardly therefrom along opposite sides of the first panel and the second panel.

Desirably, the first cap includes first tube connection means for connecting a flexible tube thereto to be in communication with the first spout and the interior of the flask to transfer fluids between the interior and exterior of the flask. The flexible tube desirably has a length to extend from the flask to proximate the mouth of a user. The flexible tube has a distal end with a bite valve attached thereto for placement in the mouth of a user and operable between an open and closed position inhibiting the flow of fluids therethrough and an open position in which fluids are not inhibited from flowing therethrough.

The portable flask desirably includes a first interior tube sized to extend from proximate the first spout a distance into the interior of said flask which distance is most desirably sufficient so the tube extends to the bottom. The first tube connection means includes means for connecting the first interior tube to be in fluid communication with the flexible tube.

Preferably the cap has a first cap aperture formed therein. The first tube connection means is formed to extend through the first cap aperture.

The second cap includes second tube connection means for connecting a second flexible tube to be in communication with the second spout and the interior of the flask to transfer fluids between the interior and exterior of the flask. The second flexible tube has a distal end to which pump means is attached for pumping fluid into the interior of the flask.

In some desired arrangements, the pump means is a bulb that is deformable and operable between a first position in which the bulb has a first hollow interior with a first volume and a second position in which the bulb is deformed to have an interior with a second volume smaller than the first volume. The pump means further includes a valve connected between the bulb and said distal end of the second tube, said valve being operable between an open position to allow fluid therepast and a closed position inhibiting the flow of fluid therepast. The bulb may be any device that can pump air into the flask. Here the bulb has a first aperture for connecting to the valve and a second aperture to which a check valve is connected. The check valve is operable between an open position in which fluid such as air may pass therethrough from exterior the bulb to interior the bulb and a position to inhibit the flow of fluid from interior the bulb to exterior the bulb.

Alternate embodiments of the invention include flasks with one, two or more spouts in the perimeter along with one or more spouts formed in a side panel of the flask.

BRIEF DESCRIPTION OF THE DRAWINGS

In the drawings which illustrate what are presently regarded as preferred embodiments of the inventions.

DESCRIPTION OF ILLUSTRATED EMBODIMENTS

Figure 1:
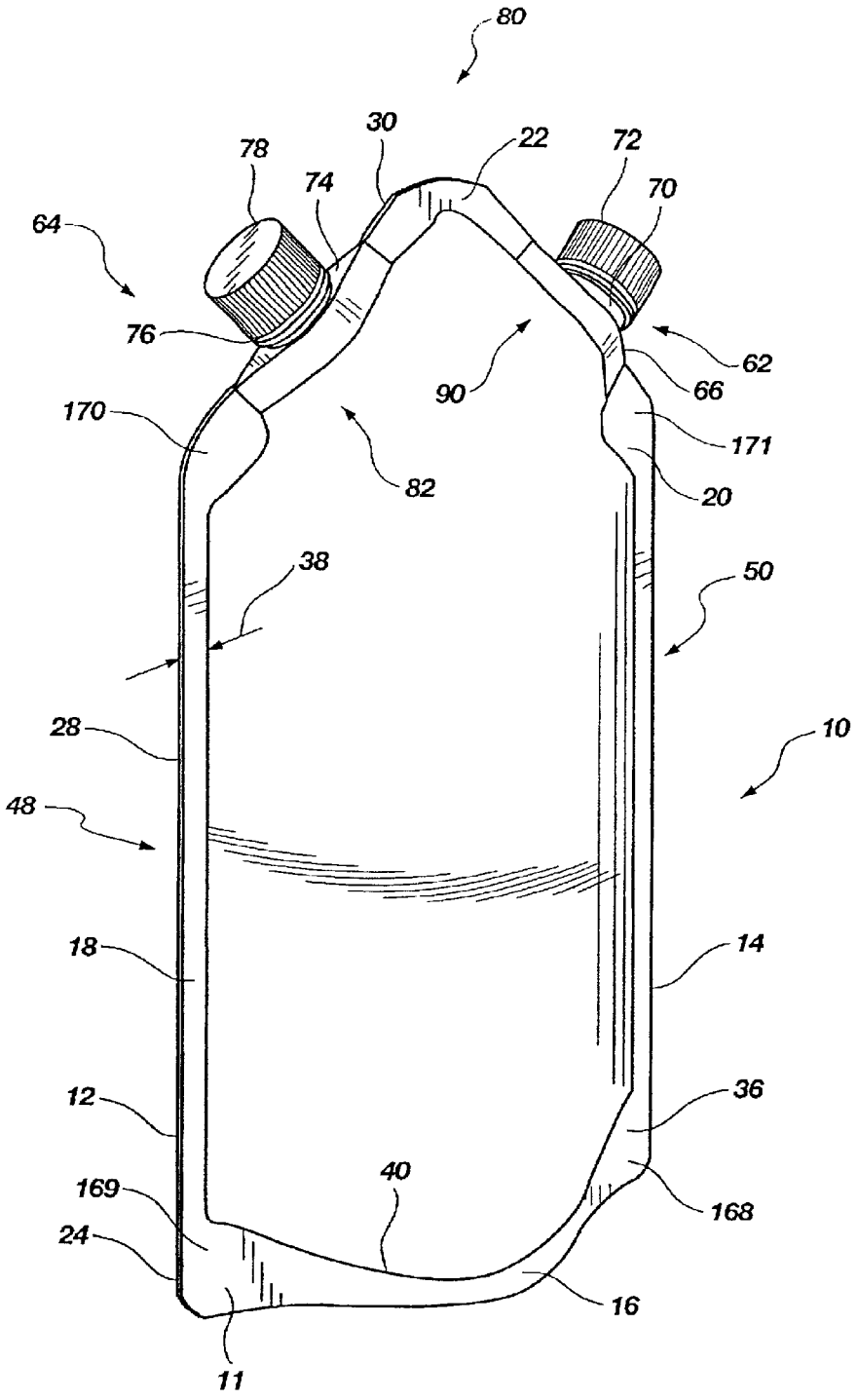
FIG. 1 is a perspective view of a flask of the present invention.

A flask 10 shown in FIGS. 1–5 has a first panel 11 and a second panel 12 of substantially identical shape joined to each other to form the flask 10 with flask perimeter 14. The first panel 11 has a bottom 16, a left side 18, a right side 20 and a top 22. Similarly, the second panel 12 has a bottom 24, a left side 26, a right side 28 and a top 30.

The first panel 11 and the second panel 12 are both made of pliable plastic and sized preferably identically. However, they may be different so that a user may trim excess or undesired material from one or the other panel so they end up about the same. Virtually any liquid or water retaining plastic will be suitable so long as it has sufficient strength to retain the liquids that are placed in the flask 10 and at the same time is essentially chemically inert to substances that may be placed in the flask 10 including, but not limited to, water, citrus drinks, fruit juices, food juices, alcoholic beverages, soups and the like. Indeed, the plastic is selected to be inert to any food including liquid foods.

The first panel 11 and the second panel 12 may be formed in any convenient way including die cutting. If formed by die cutting, the first panel 11 and the second panel 12 are preferably formed using the same die so each will in turn be substantially identical in dimension to the other. Further, the first panel 11 and the second panel 12 may be formed from a roll of sheet plastic and in turn will be effectively flat or planar upon die cutting. Alternately, the first panel 11 and second panel 12 may also be formed from sheet plastic by other processes such as vacuum molding so that both the first panel 11 and the second panel 12 each have a middle portion that is distended or ballooned out from the plane of the plastic so that upon assembly a space for the fluids is defined.

The first panel 11 has perimeter 32 and the second panel 12 has perimeter 34. To form the flask 10, the first panel 11 and second panel 12 are mated together and aligned one with the other. Thereafter a perimeter seal 36 is formed by sealing about the perimeters 32 and 34 to form the flask perimeter 14. The sealing may be effected by any available or suitable process including heat sealing, plastic welding, by electromagnetic means or even ultrasonic energy. Various glues may also be used in some applications. The perimeter may also be mechanically folded to effect a seal. The perimeter seal 36 has a depth 38 which extends inwardly from the perimeter 14 a distance which may be from about one fourth of an inch to as much as one inch except along the bottoms 16 and 24 of the panels 11 and 12 where the depth 38 is typically greater and at the corners as hereinafter discussed.

Figure 1A:
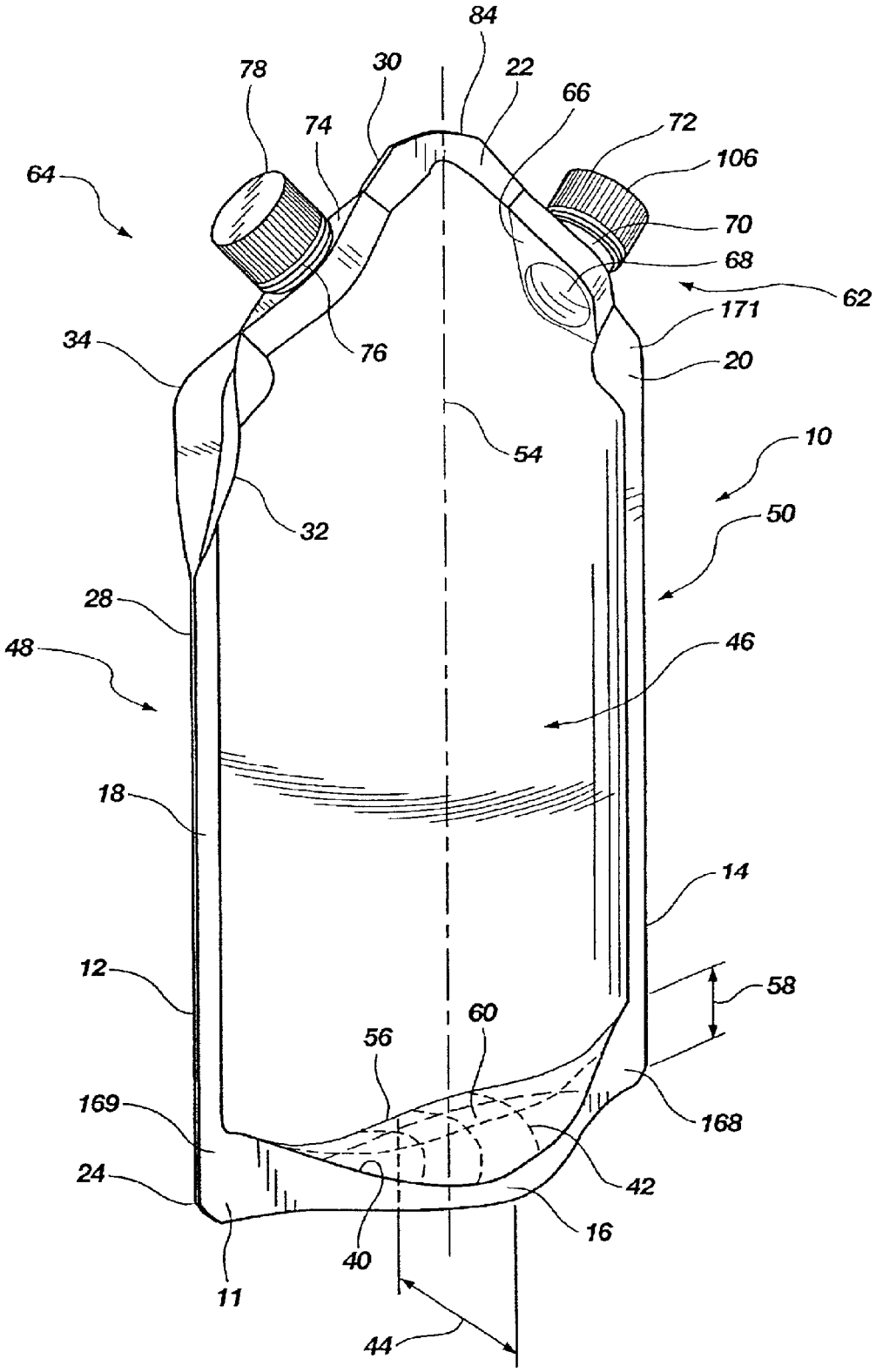
FIG. 1A is a perspective view of the flask of FIG. 1 with a portion of the panel members not sealed one to the other.

As better seen in FIG. 1A, a third panel 42 is positioned to extend between the side panels 11 and 12 proximate the bottoms 16 and 24. The third panel 42 is made of plastic similar to and preferably the same as the plastic of the panels 11 and 12. The third panel 42 acts as a gusset or insert so that panels 11 and 12 may extend away from each other a distance 44 as liquid is introduced into the interior 46 between panel 11 and panel 12. That is, the liquid has mass and in turn exerts a force that urges the panels 11 and 12 apart. The third panel 42 allows the panels 11 and 12 to move apart while the panels 11 and 12 of flask 10 essentially retain dimensional integrity.

Without the third panel 42, the liquid being introduced will urge the panels 11 and 12 apart and at the same time cause the flask sides 48 and 50 to deform or dent inwardly toward axis 54. If the flask 10 is in a neoprene container like the container 52 shown in FIG. 12, the container 52 may also dent or distort. If the flask 10 is to be carried on the person, it can be seen that the distortion could cause a surface or an edge to be presented that may rub against the user or equipment and damage the flask 10 or the equipment or cause the user some discomfort. In addition, the force of the liquids may stress the perimeter seal 36 and in turn lead to leaks.

With the third panel 42 installed as seen in FIG. 1A, the sides 48 and 50 tend to remain relatively straight when the interior 46 is filled with liquid so that the flask 10 substantially retains or maintains dimensional integrity. Further, the third panel allows for greater deflection of the side panels 11 and 12 so that the flask 10 may contain a greater volume of liquids. At the same time, the movement of the panels 11 and 12 outwardly near their bottoms 16 and 24 from the axis 54 forms a base with a footprint that has width and length so that the flask 10 may in some cases stand in an upright manner from a horizontal surface with the axis 54 generally normal to the surface. In short, with the third panel 42 in place, the flask 10 may be freestanding.

The third panel 42 is sealed to the bottoms 16 and 24 to form a first bottom inner edge 40 and a second bottom inner edge 56. The third panel 42 is also sealed to the panels 11 and 12 along the flask sides 48 and 50 a distance 58 extending upward from the bottoms 16 and 24. The distance 58 is about half the widest distance 44 of the third panel 42. When the flask 10 has no liquid, the side panels 11 and 12 may be urged into contact with each other expelling any remaining liquid and any air or other gas. At the same time, the third panel 42 folds upwardly upon itself along crease 60.

The flask 10 of FIGS. 1–5 has a first spout 62 and a second spout 64. The first spout 62 has a first base 66 (FIG. 1A) with a first aperture 68 formed therein and extending through the base and into the neck 70. Cap 72 is attached to the neck 70 by threading as discussed with respect to FIG. 13 below. Liquids may be transmitted into and out of the flask 10 through the first aperture 68. The first spout 62 is positioned between the first panel 11 and the second panel 12 and sealed to and between the first panel 11 and second panel 12 along the perimeter 14 of the flask 10 to be part of the perimeter seal 36.

Figure 13:
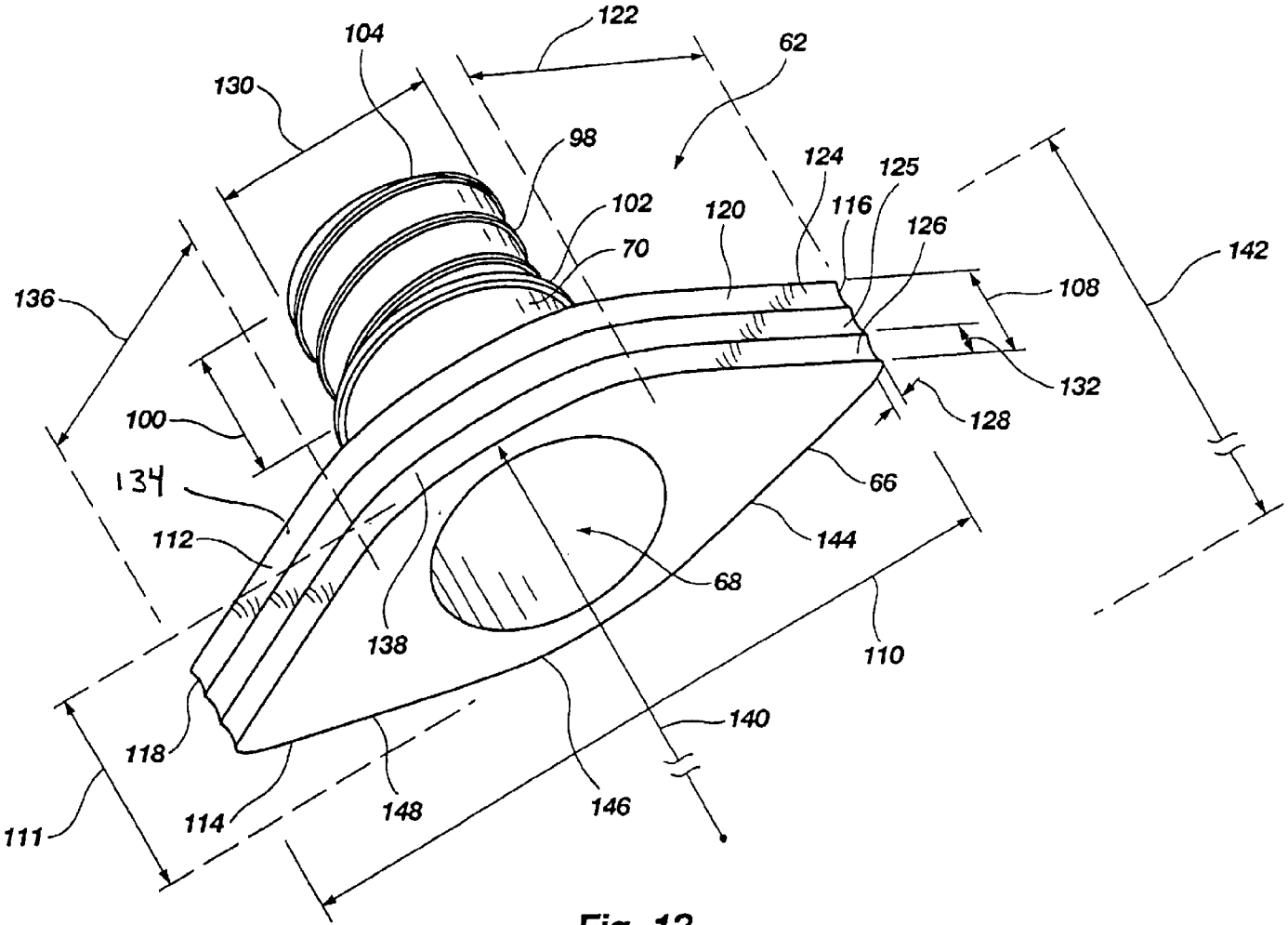
FIG. 13 is a perspective view of a spout suitable for use with flasks of the present invention.

Similarly, the second spout 64 has a second base 74 which has an aperture formed therein (not shown) to extend through the base 74 and into the neck 76 to which the second cap 78 is attached as discussed with respect to FIG. 13.

Figure 2:
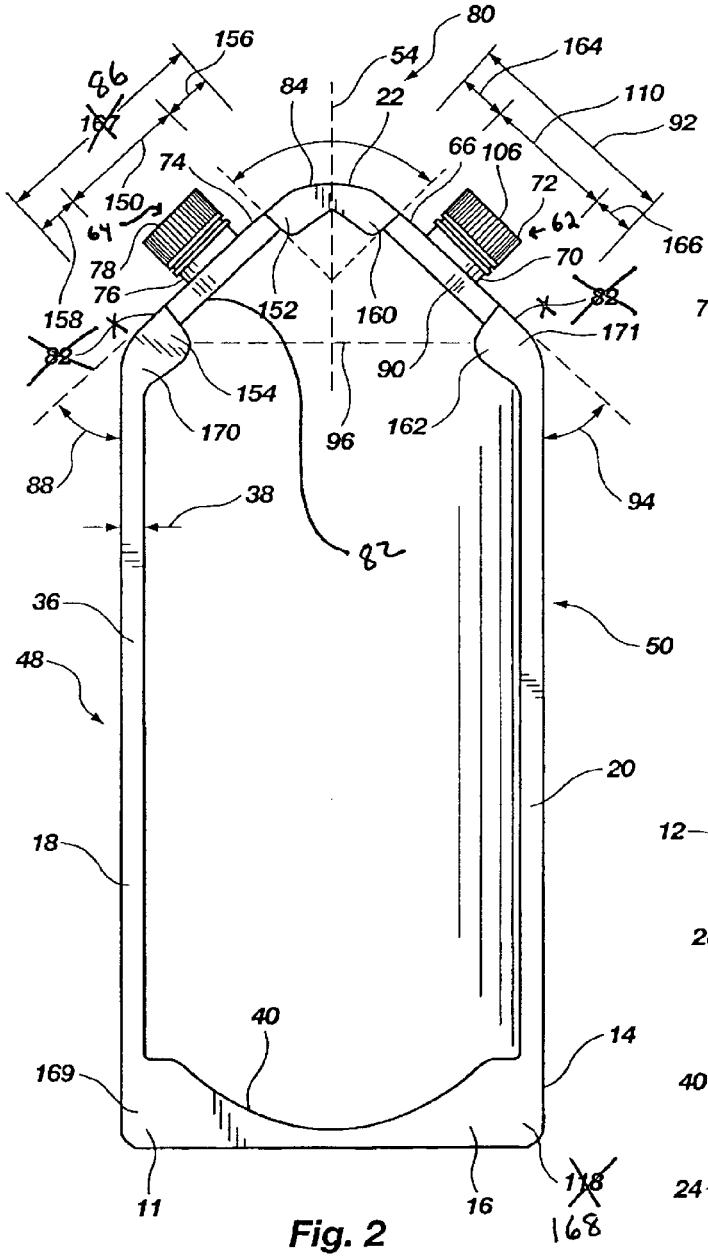
FIG. 2 is a side view of the flask of FIG. 1.

The flask 10 has a top 80 which extends between the sides 48 and 50. It is formed from and with the first panel 11 and the second panel 12. The top 80 as better seen in FIGS. 1, 1A and 2 is triangular in appearance with a first section 82 extending from side 48 to middle section 84 a distance 86 at an angle 88 which is here shown to be about 45 degrees. The angle 88 may be from about 30 degrees to about 60 degrees. The top 80 has a second section 90 which extends from the side 50 to the middle section 84 a distance 92 which is preferably the same as distance 86 and at an angle 94 which is selected to be the same as angle 88. Thus the top 80, in side view as depicted, may be likened to an isosceles triangle with sections 82 and 90 as the legs and an imaginary line between the sides 48 and 50 at their intersection with the sections 82 and 90 as the base.

FIG. 13 shows first spout 62 with the first cap 72 removed to show all of the neck 70 including threads 98 formed in the neck 70 for threaded attachment of the cap 72. The height 100 of the neck 70 above the ledge 102 is selected to receive the cap 72 and form a compression seal between the inner surface of the top 106 of the cap 72 and the upper edge 104 of the neck 70 when the cap 72 is threaded onto the neck 70.

The base 66 of the first spout 62 is shown to have a height 108 and a width 10. The base 66 is formed to have a first side 112 and a second side 114 each of which is formed to intersect or join each other to form a first tip 116 and a second tip 18. The first side 112 is shown to have a first part 120 which extends from the first tip 116 a distance 122 which is selected so that a good seal can be effected with one of the first panel 11 and the second panel 12. The first part 120 is generally planar with a plurality of three grooves 124, 125 and 126. The grooves 124–126 each are arcuate with a depth 128 selected to facilitate the formation of a seal between the first panel 11 or the second panel 12 and the first side 112.

The length 122 and the width or height 108 of the first part 120 is selected to provide sufficient surface to effect a good mechanical bond or seal to hold the first panel 11 or second panel 12 thereto. The length or distance 122 may be from about one-half an inch to about two inches but is here selected to be about one inch. The distance 122 of one inch has been found to be suitable for a spout 62 having a length 110 of about two inches to three inches and specifically about two and three eighths inches. Such a spout may have a neck 70 which is circular in cross section with an inside diameter 130 of about three fourths of one inch. The grooves 124–126 all have about the same width 132 with the height 108 in total being from about three eighths of one inch to one inch with a preferred height 108 of about seven sixteenths of one inch. The depth 128 of each groove may vary but are here all the same and may be from about one millimeter to about three millimeters with the depth 128 of about two millimeters being preferred.

A second part 134 extends from the second tip 118 a distance 136 and is also planar with grooves 124–126 extending therealong to be virtually the same as the first part 120. In between the first part 120 and the second part 134 is an arcuate part 138 which is essentially a section of the side of a cylinder with a radius 140 sized in length 142 to be more than one half the inside diameter 130 of the neck 70 but less than about three times inside diameter 130. In the illustrated arrangement, the radius 140 is selected to have a length 142 from about one and one-half inches to about four inches and preferably is about two inches. The arcuate part 138 has the grooves 124–126 extending therealong as shown.

The second side 114 also has a first part 144, an arcuate part 146 and a second part 148 and in effect is a mirror image of the first side 112. The second spout 64 is sized and shaped to be the same as the first spout 62. Of course it may be also larger or smaller in overall size. In some applications, it may be desired to have the second spout sized with a neck having an inside diameter of one and one-half inches to more easily accommodate the introduction of ice into the flask 10.

Figure 3:
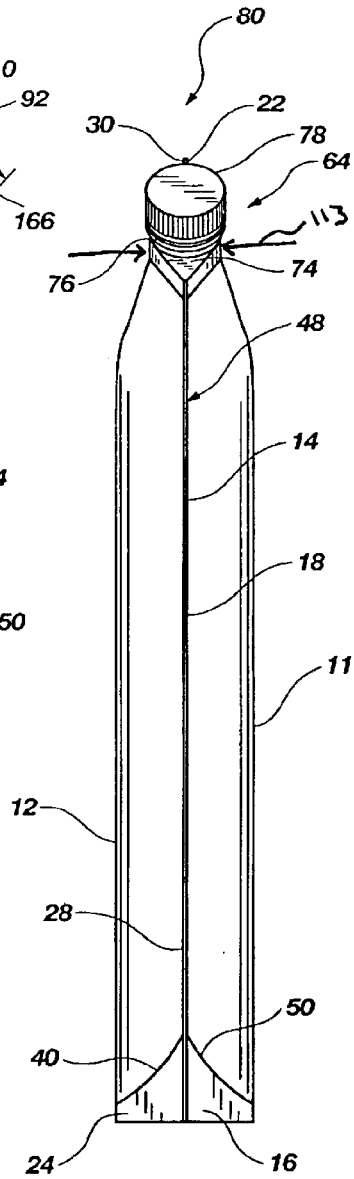
FIG. 3 is another side view of the flask of FIG. 1.
Figure 4:
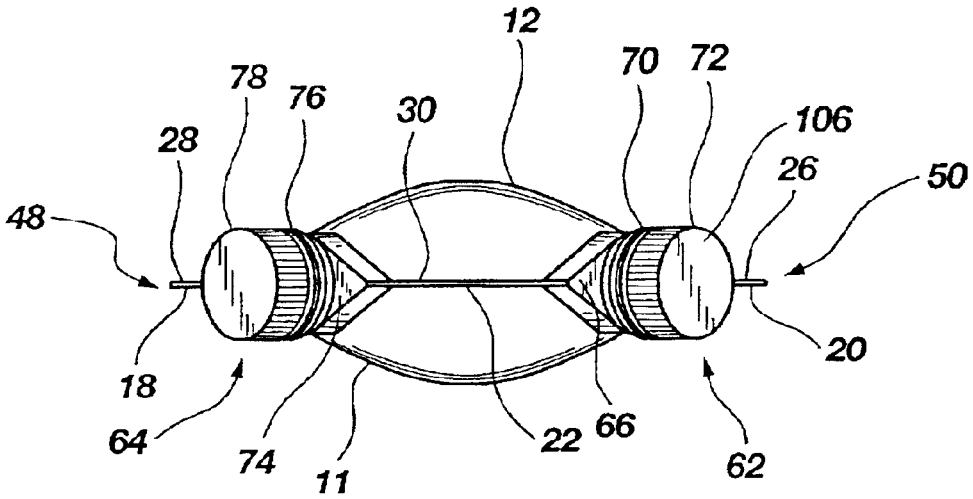
FIG. 4 is a top view of the flask of FIG. 1.
Figure 5:
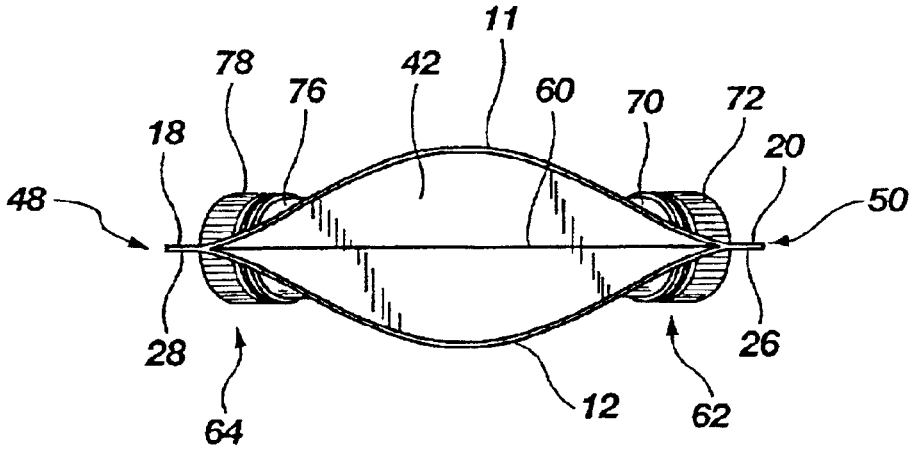
FIG. 5 is a bottom view of the flask of FIG. 1.

In FIG. 2, it can be seen that section 82 is sized in length 86 to receive the second spout 64 between the first panel 11 and the second panel 12 along the perimeter seal 36. In the illustrated flask 10, the spout 64 is sized in length 150 the same as the length 110 of the first spout 62. When the second spout 64 is sealed into place in the section 82, an upper extension 152 and a lower extension 154 are formed so that each is sized in length 156 and 158 respectively about the same. The lengths 156 and 158 are selected to provide a secure connection or seal area extending from the second spout 64. That is, the spout 64 transmits torques or forces to the perimeter seal 36. For example, rotating the cap 78 on and off creates torque or forces. Various other forces may be applied to the neck 76. The torques or forces can act to urge the first panel 11 away from the second panel 12. It has been found that forming the upper extension 152 and a lower extension 154 to be sized in length 156 and 158 respectively from about one-half inch to about one and one-half inches stabilizes the perimeter seal 36 and limits the risk of damage to the perimeter seal 36 along the second section 82 from the torques or forces that are from time to time transmitted to the perimeter seal 36 by the second spout 64. Sizing the upper extension 152 and the lower extension 154 to be about three fourths of an inch has been found to be suitable for a spout 64 having an overall length 150 of about two and three eights of an inch and a width 113 (as shown in FIG. 3) of about one and one eighth of an inch.

Turning to the second section 90, it contains the first spout 62 and is assembled in a fashion and dimensioned substantially the same as the second spout 64 and the first section 82. However it could be a spout of a different size or even of a different type as desired.

The first spout 62 is sealed into place between the first panel 11 and the second panel 12 the same as the second spout 64. An upper extension 160 and a lower extension 162 are each sized in length 164 and 166 to be the same as the length 156 and 158 of the upper extension 152 and lower extension 154 for the same reasons. However using a spout of different dimensions may result in an upper extension 160 and a lower extension 162 of dimensions that are different from those of upper extension 152 and lower extension 154.

Between the first section 82 and the second section 90 is the middle section or top 80 which is here formed of the first panel 11 and the second panel 12 sealed together as part of the perimeter seal 36. The depth 38 of the perimeter seal 36 at the top 80 is increased to be as much as one-half to three-quarters of an inch because of increased structural stress that will be transmitted to the top 80 during use. The top 90 is illustrated to be rounded to avoid a sharp point and possible injury to associated pouches or the like and possible injury to users.

It may be noted that the perimeter seal 36 of depth 38 is greater at the corners 168–171 because the corners are believed to receive the greatest structural stress in use.

Figure 6:
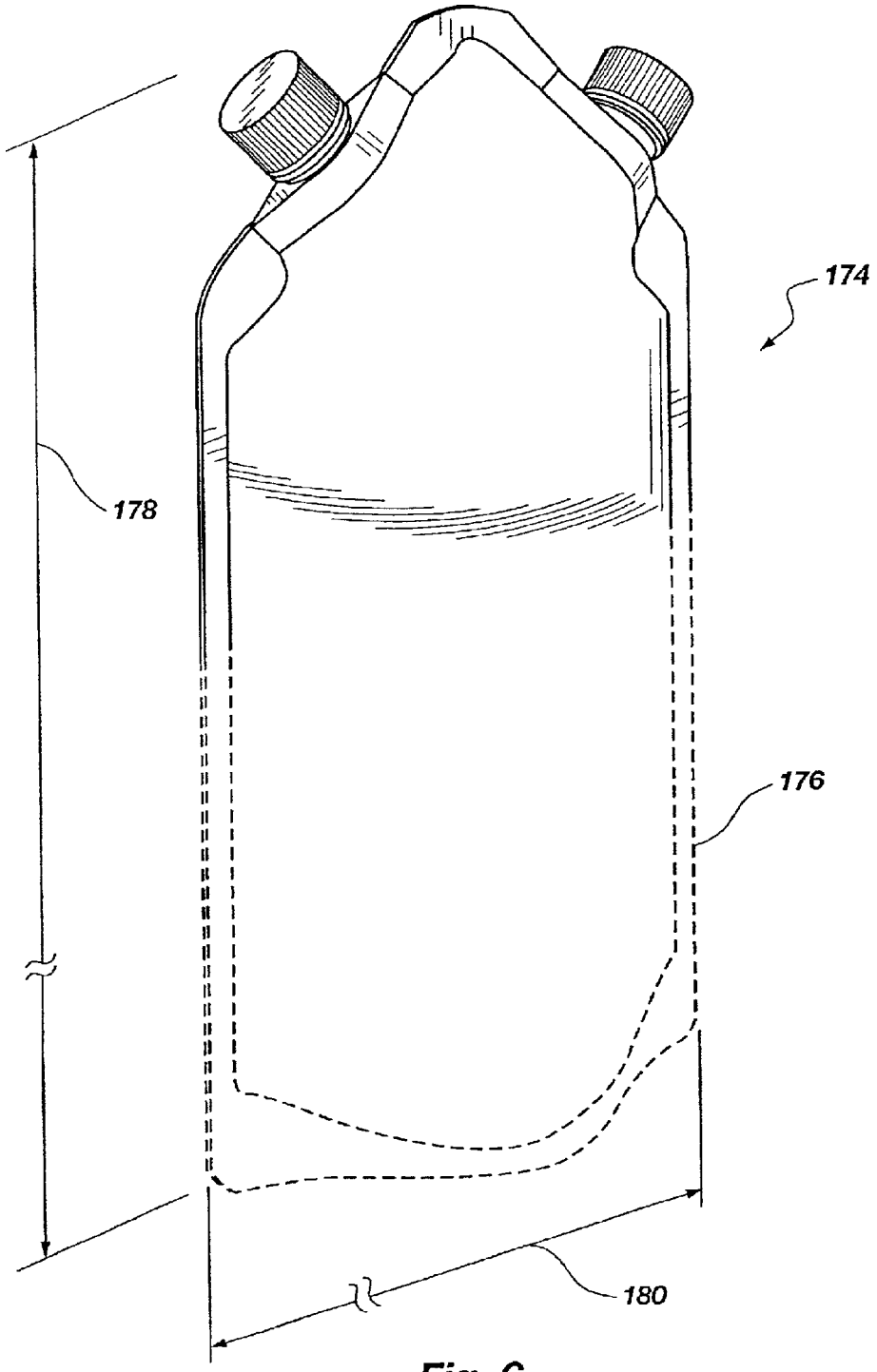
FIG. 6 is a perspective view of a flask of the present invention with a portion shown in phantom.

FIG. 6 depicts a flask 174 which is comparable in form as flask 10 of FIG. 1 with a portion 176 shown in phantom to reflect that the length 178 of the flask 174 and the width 180 may vary.

Figure 7:
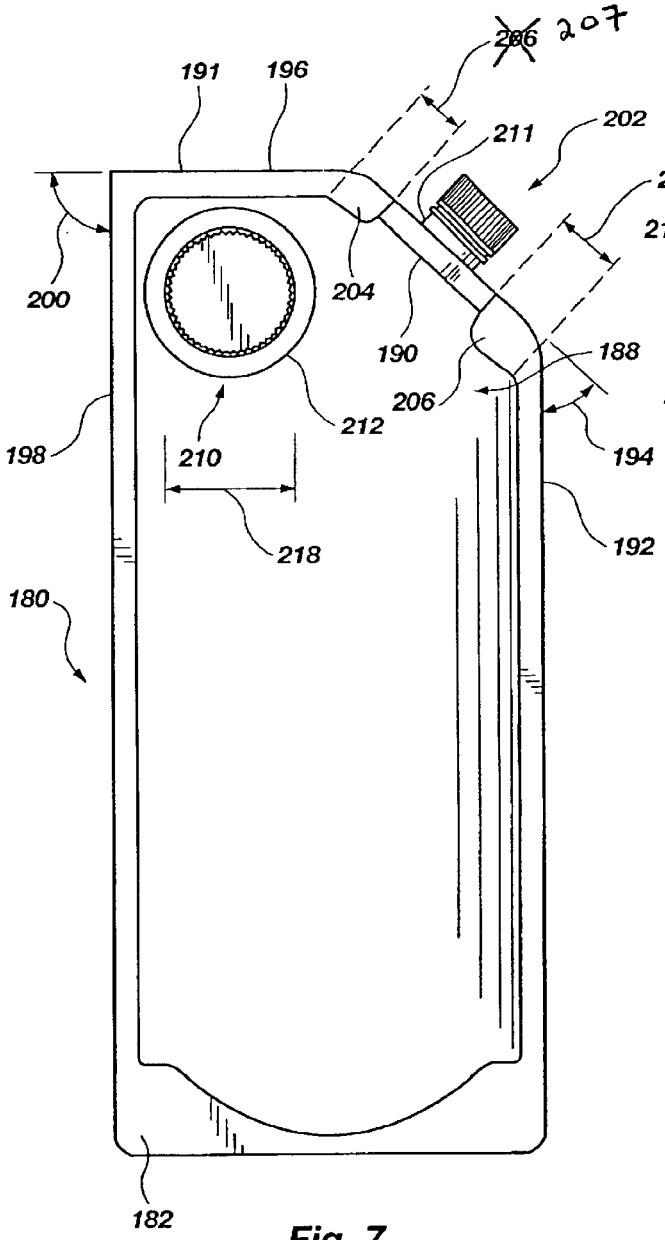
FIG. 7 is a side view of an alternate embodiment of the present invention.
Figure 8:
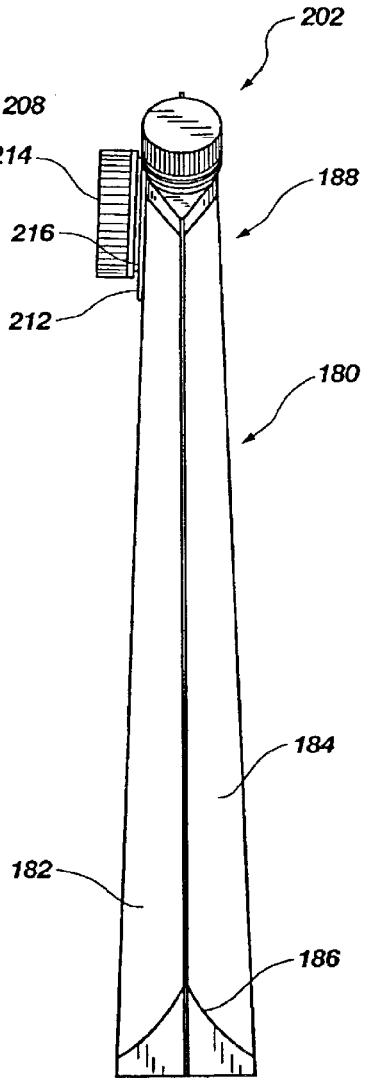
FIG. 8 is a side view of the flask of FIG. 7.

FIGS. 7 and 8 show a flask 180 made in a manner comparable to the flask 10 of FIG. 1. It has front panel 182 and a back panel 184 with a bottom panel 186 assembled substantially as described. The upper portion 188 is formed to have a first section 190 extending away from the right side 192 at an angle 194 from about 30 degrees to about 60 degrees and preferably about 45 degrees to intersect a top section 196. The top section 196 intersects the left side 198 at a right angle 200 as shown but may intersect at any angle 200 from fifteen degrees to substantially more than 90 degrees and as much as 150 degrees.

In FIGS. 7 and 8, a first spout 202 is shown which is the same in size and shape as the spout 62 shown in FIG. 13. It is positioned in the first section 190 of the perimeter 191 and sealed between the front panel 182 and the rear panel 184 with extensions 204 and 206 formed and sized in length 207 and 208 to be substantially the same for the reasons as stated in reference to extensions 152, 154, 160 and 162 shown in FIG. 2. A second spout 210 is shown positioned in the front panel 182 sealed to and in the front panel 182. The second spout 210 has a base 212 which is connected to the front panel 182 by an adhesive, by heat sealing or by a mechanical seal, as may be desired. The second spout 210 has a cap 214 which is threaded onto the neck 216 of the second spout 210 to effect a seal comparable to that shown in FIG. 13 for the spout 62. The cap 214 may be attached by other means to form a friction seal or any other kind of seal effective to retain the liquid in the interior of a flask or other container. The second spout 210 has a neck 216 substantially circular in cross section with a diameter 218 selected to pass ice or other selected solid material that is larger in cross section or shaped so that it may not fit through the neck 211 of the first spout 202.

Figure 9:
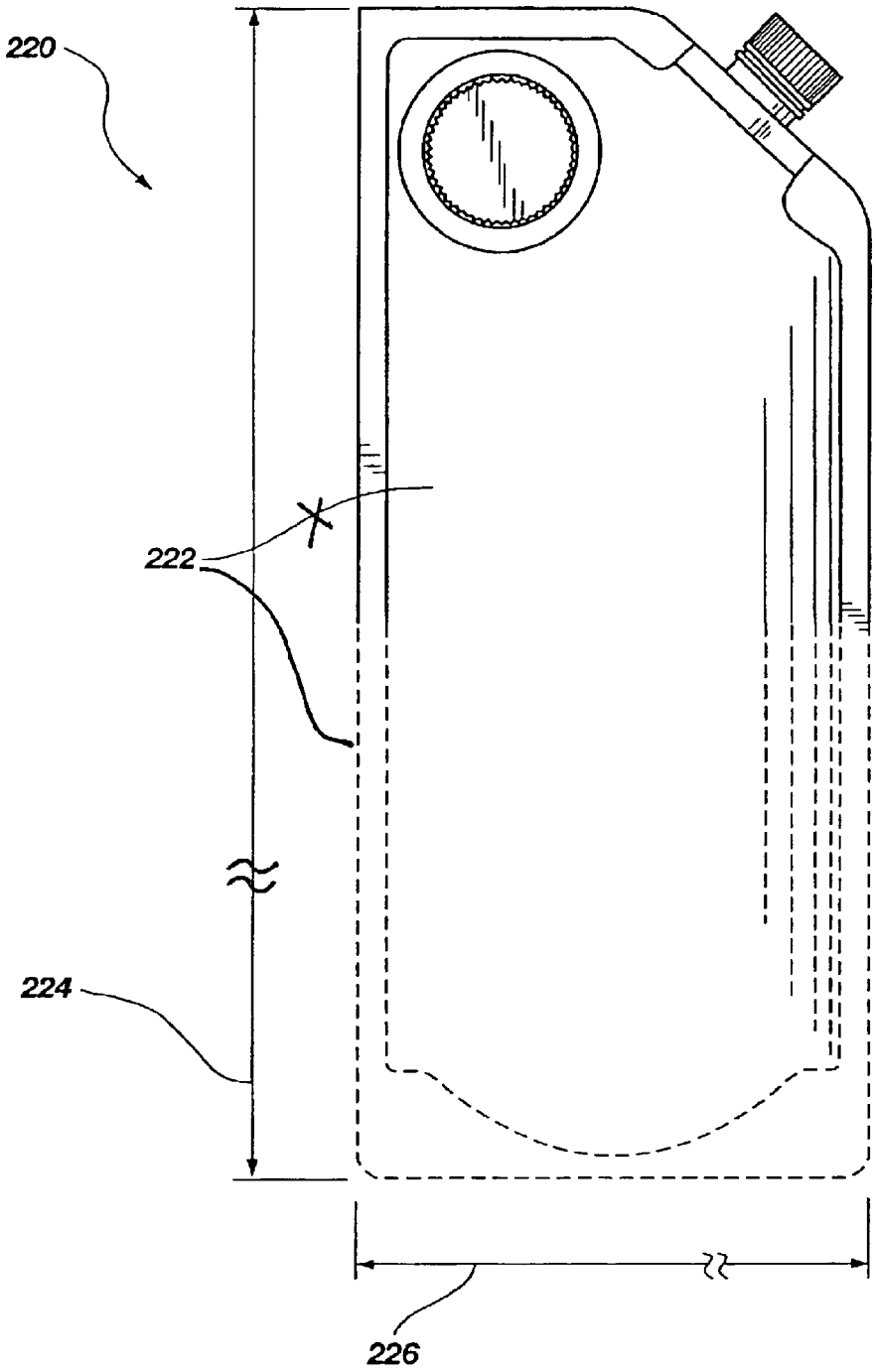
FIG. 9 is a side view of a flask of the present invention with a portion shown in phantom.

FIG. 9 shows a flask 220 shaped and sized comparable to flask 180 with a portion 222 sown phantom to reflect that the flask may have differing lengths 224 and widths 226.

Figure 10:
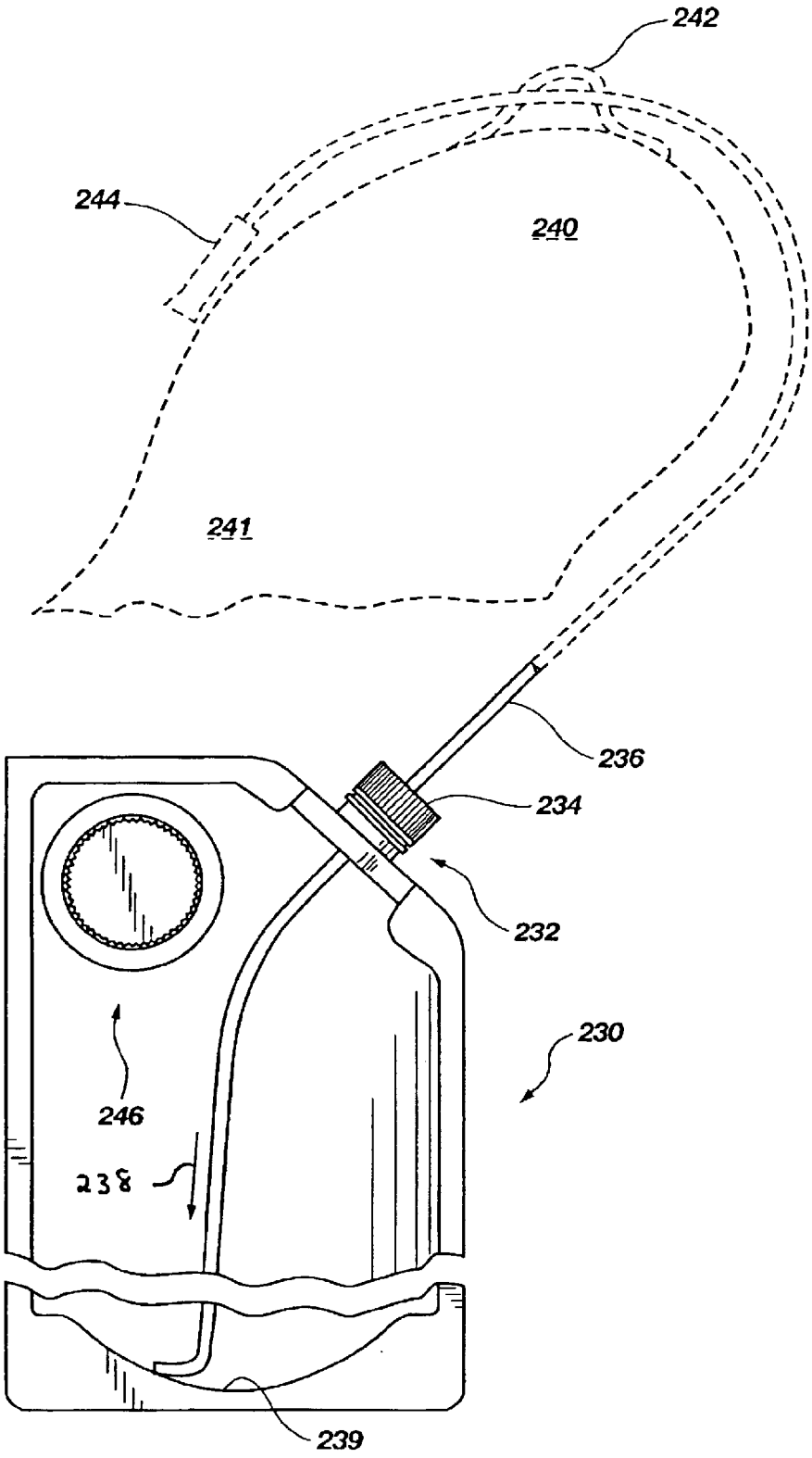
FIG. 10 is a partial side view of a flask of the present invention with drinking mechanism attached.

FIG. 10 shows a flask 230 comparable in size and shape to flask 180 configured for attachment to a user or for positioning in a container for further attachment to or transport by the user. The flask 230 is shown with a first spout 232 having a cap 234 configured to receive a transport tube 236 through an aperture. That is, the transport tube 236 extends snugly through an aperture formed in the cap 234. Alternately a seal may be formed to seal the transport tube 236 as it passes through the cap 234. The transport tube 236 is made of any suitable plastic or plastic-like material and is sized in length to extend downwardly 238 into the interior of the flask and preferably to the bottom 239 of the flask 230 so that all liquid may be communicated from the flask 230. The transport tube 236 extends away from the cap 234 a distance so that a user may insert it into the user's mouth to receive liquids from the flask 230. In FIG. 10, the transport tube 236 is sized in length to extend over the shoulder 240 and arm 241 and through a retaining loop 242 formed on a shirt or other article of clothing of the user to retain the transport tube 236 and the bite valve 244 for easy access on the front of the user's clothing proximate the mouth. The flask 230 may thus be attached to a backpack or otherwise to the user's person where it is out of the way.

Notably the second spout 246 is comparable to spout 210 and is positioned near the top of the flask 230 to receive liquids without the need to remove the cap 234 for access and to insert ice cubes. Thus a user need not remove the cap 234 and the transport tube 236 to insert liquids or other materials such as ice, and thereby run the risk of contaminating the cap 234 and the tube 236 from contact or association with other surfaces.

Figure 11:
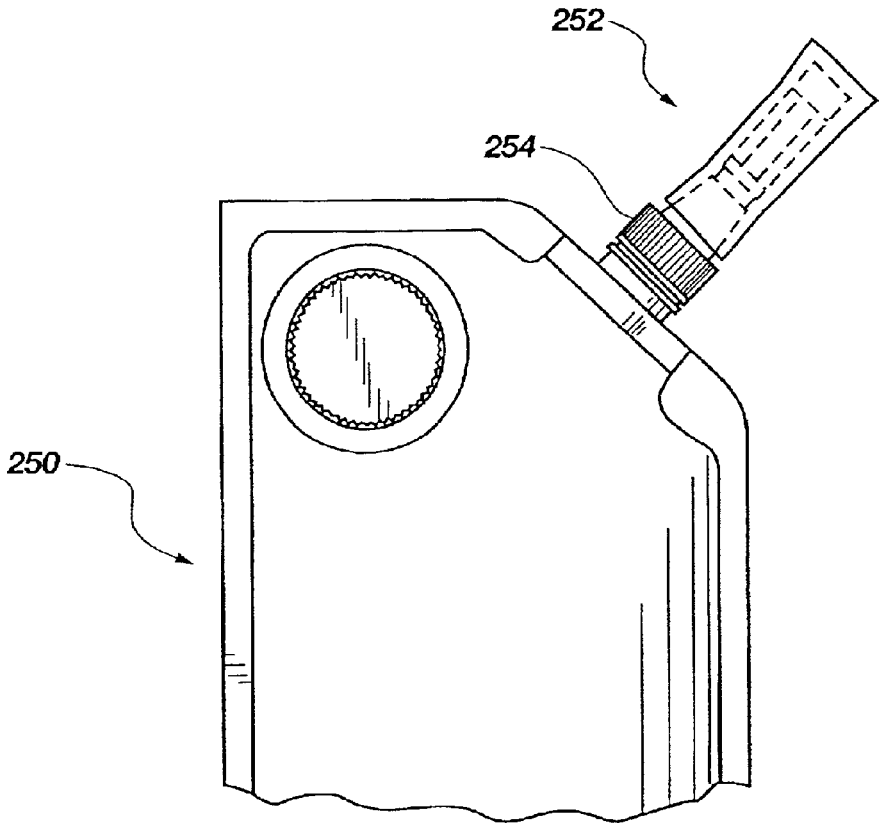
FIG. 11 is a partial side view of a flask of the present invention with an alternate drinking mechanism attached.

FIG. 11 shows a flask 250 comparable to flask 230 with a bite valve 252 attached to the cap 254. The bite valve 252 may be any such type found in the art and preferably is of the type disclosed and illustrated in U.S. Pat. No. 5,971,357, the disclosure of which is incorporated herein by this reference.

Figure 12:
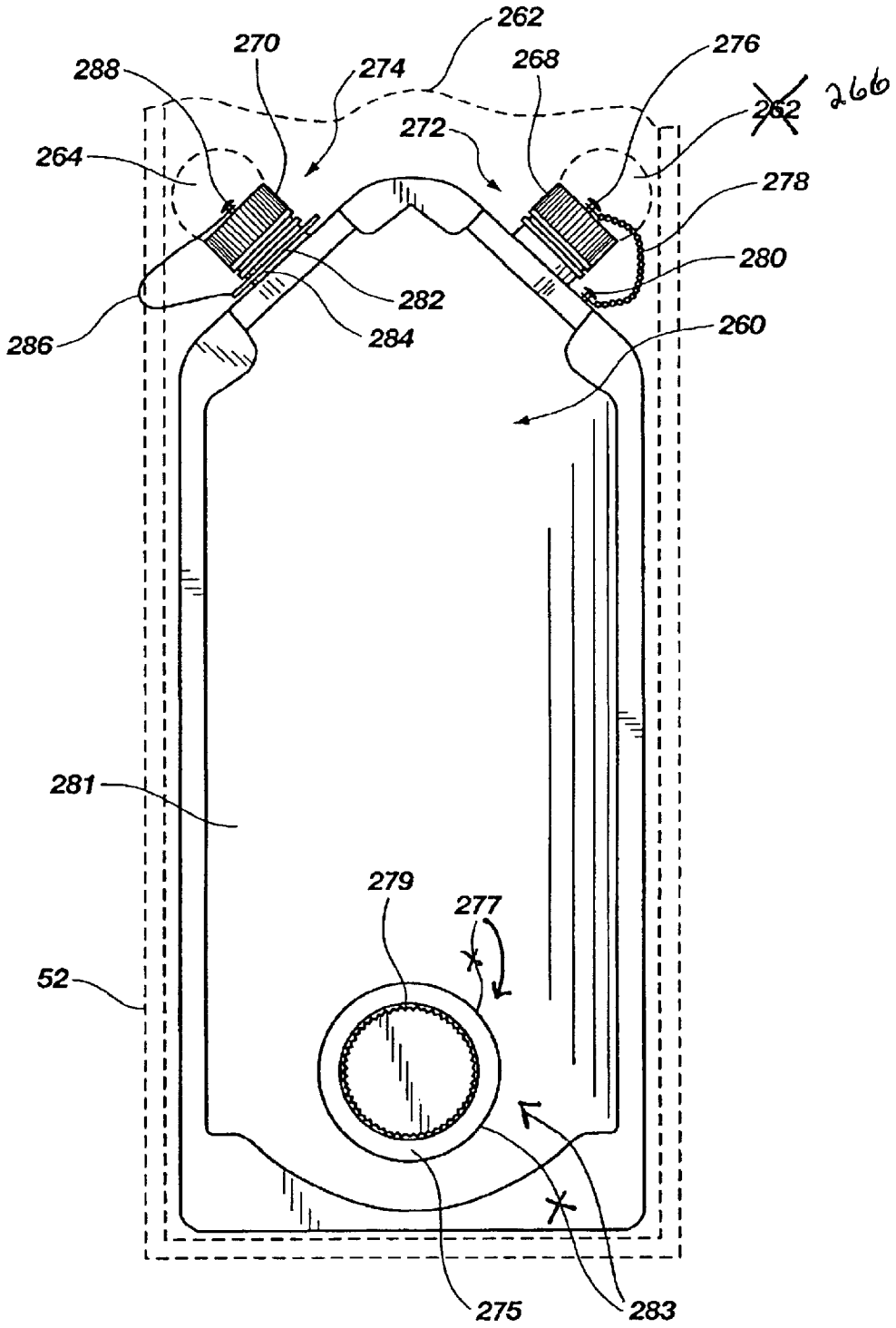
FIG. 12 is a side view of a flask of the present invention with a portion of a pouch shown in phantom.

FIG. 12 depicts a flask 260 comparable to the flask 10 of FIG. 1. The flask 260 is positioned within a neoprene container or bag 52 which functions to hold the flask 260, to provide convenient structure for appending securement structures (e.g., belt loops) for attaching to the user, and to insulate the flask 260 to retain heat or to retain cold. The bag 52 has a flap 262 with holes 264 and 266 to register with the caps 268 and 270 of spouts 272 and 274. Cap 268 is shown with a pin 276 attached to it (e.g., by gluing) with a chain 278 attached thereto and extending to another pin 280. The chain 278 is attached to the pins 276 and 280 by a small flange with a hole in it through which the pins 278 and 280 are attached.

The cap 270 of the second spout 274 has a plastic collar 282 positioned about the neck 284 to rotate thereabout. A plastic tether 286 extends therefrom to the cap 270 for rotatable attachment thereto by pin 288. The caps 268 and 270 may each rotate while the chain 278 and the tether 286 retain it relative to the spout 272 and 274 upon removal. Other arrangements may be used to secure the cap of a spout relative to the neck of each spout. Such arrangements allow the user to remove a cap and limit the risk of contamination or loss.

FIG. 12 also shows a third spout 277 attached to and formed in the side panel 281 near the bottom 283. The bag 52 may be positioned generally horizontally on a table or other flat surface after which the cap 279 may be removed. Upon removal solids like ice can be more easily introduced into the interior of the bag. It should be understood that flasks or bags of this invention may include bags with three or more spouts to facilitate the introduction of solids and the simultaneous extraction of fluids under pressure. The third spout 277 is attached to the side panel 281 in any suitable fashion. Here the spout 277 has a flange portion 275 with a neck portion that is attached and preferably unitarily formed with the flange portion 275. The neck portion extends up through an appropriately sized aperture formed in the side panel 281. The flange portion 275 may be glued, beat sealed or welded to the side panel 281 as desired to effect a sealed attachment.

Figure 14:
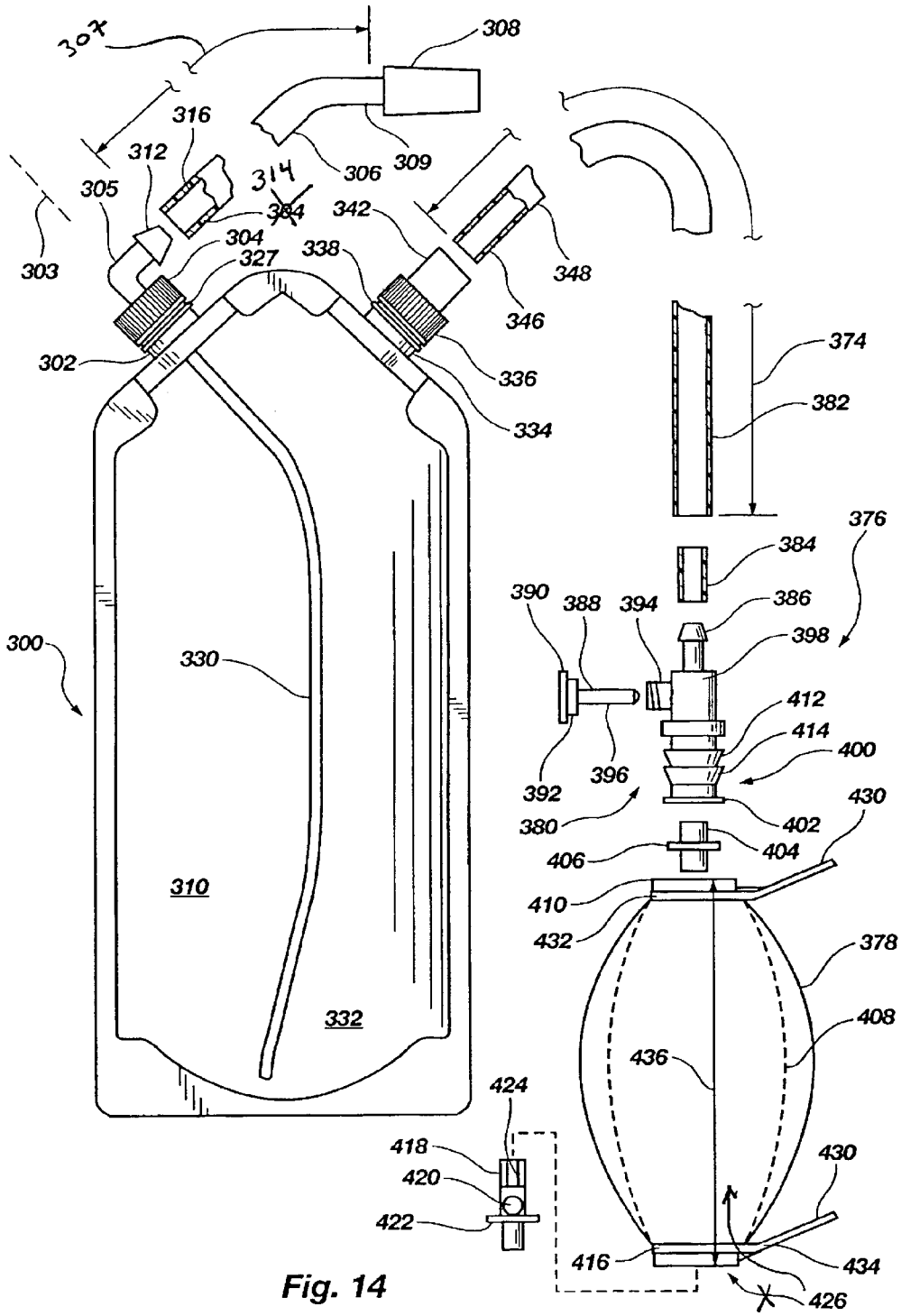
FIG. 14 is a partial side view of a flask assembly of the present invention configured with a pump and a supply.

FIG. 14 depicts a flask 300 comparable to flask 10 of FIG. 1 showing a distinct advantage of a double spout flask. Specifically the double spout flask here shown includes additional structure assembled for pressurizing the flask interior and a separate delivery structure for delivering fluids from the interior under pressure to the user. As can be seen in FIG. 14, spout 302 has a first cap 304 attached thereto. The first cap 304 has a first tube connecting means, such as connector 305, for connecting a tube 306 that extends to a bite valve 308. The connecting means is any device that provides for the communication of fluids and specifically liquids from the interior 310 of the flask 300 to the tube 306. The bite valve 308 is any bite valve that is operable by the user's mouth and more specifically by clamping down with the user's jaws to compress the valve and move it between an open position and a closed position. Preferably, the bite valve 308 is of the type illustrated and described in U.S. Pat. No. 5,971,537 (Denton, et al.) the disclosure of which is incorporated by this reference. Other bite valves may be used as desired. In lieu of a bite valve, a user may elect to provide a clamp or a small valve operable by the user to regulate the flow of liquids therethrough.

The tube 306 is any suitable flexible tubing made from a substance that does not chemically interact with the various liquids that may be placed in the flask 300. Polyethylene tubing is one example. The tubing 306 shown here is similar to other tubing discussed hereinbefore and is vinyl tubing or any other flexible plastic-like or rubber-like tubing here having an outside diameter of about 10 millimeters. It is shown disconnected from the connector 305 which has a barbed edge 312 sized to snugly receive the proximal end 314 shown in cut-away to illustrate that the tube 306 is hollow. The tube 306 has a side wall 316 that is deformable to facilitate the connection to the connector 305 over the barb 312.

Figure 15:
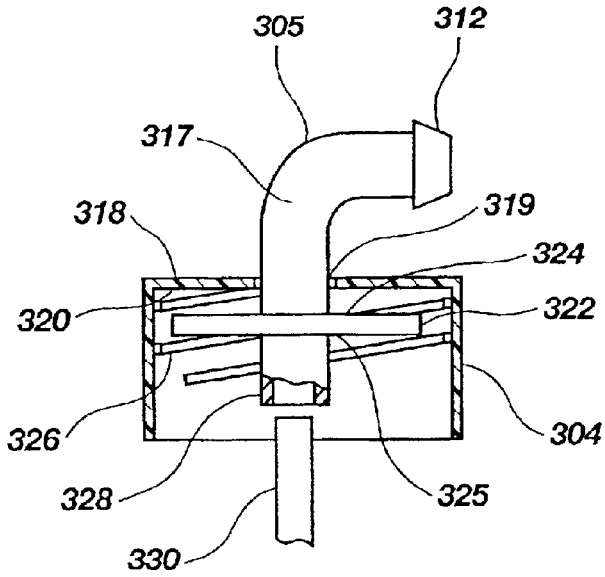
FIG. 15 is a cross sectional depiction of a cap arrangement for connection to a spout of the present invention.
Figure 16:
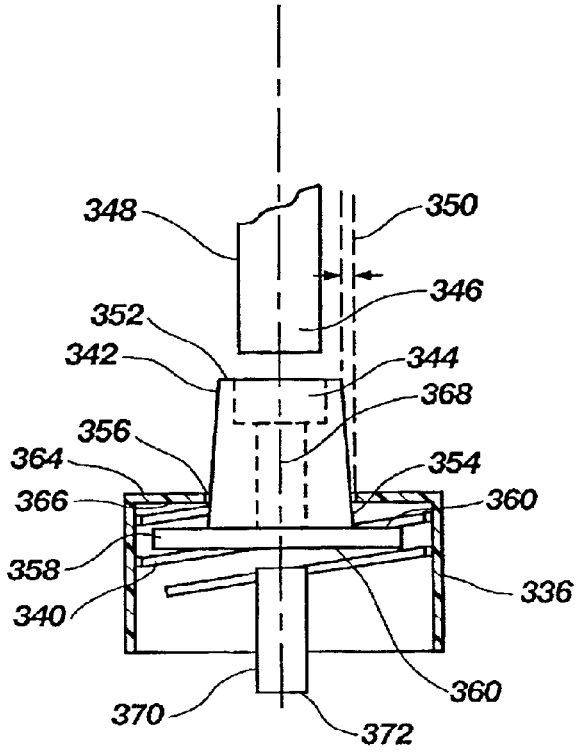
FIG. 16 is a cross sectional depiction of a different cap arrangement for connection to a spout of the present invention.

In FIG. 15, the cap 304 is shown in cross section to better illustrate the connector 305. The cap 304 has a top 318 that has an aperture 319 formed and sized to receive the connector 305 and more specifically the elbow section 317 therethrough. The connector 305 has a flange 322 with an upper surface 324 that is flat and formed to mate with the undersurface 320 of the top 318 of the cap 304. Upon threading the cap 304 onto the spout 302 of the flask 300 with threads 326 onto threads 327 (FIG. 14), the upper surface 324 is pressed against the undersurface 320 to effect an essentially liquid-tight seal. The connector is preferably made of a plastic or plastic-like material that does not chemically interact with the liquid. The cap 304 is also preferably made of plastic. Thus, as the cap 304 is threaded tightly onto the spout 302, the upper surface 324 of the flange 322 will elastically deform a little or enough to accommodate to any imperfections in the undersurface 320 of the top 318. At the same time the lower surface 325 of the flange 322 also deforms a little or enough to accommodate to any imperfections in the upper edge of the spout 302.

The elbow section 317 and in interior end 328 shown in cut-away that snugly receives the flexible tube 330. The connector 305 is here shown with an elbow section 317 to orient the tube 306 in a desired direction. The connector 305 could have a section that is straight or angulates from the axis 303 at any desired angle from zero degrees to the 90 degree elbow shown. The flexible tube 330 is sized to extend into the interior 310 of the flask and preferably to the bottom area 332 to receive fluids and communicate them to the connector 305.

The tube 306 as shown may vary in length 307 so that the flask 300 may be positioned where desired. Thus the tube 306 may be sized to extend from the area of a backpack over the shoulder of the user and around the collar area with the distal end 309 having the bite valve attached thereto so that the user can, when desired, insert the bite valve 308 into his or her mouth and operate it by clamping down and releasing the user's jaw.

FIGS. 14 and 15 also show the second spout 334 having a second cap 336 threadedly connected to the spout 334. The spout 334 has threads 338 that mate with cap threads 340 to effect the threaded connection. Connector means is associated with the cap 336 so that liquids and more specifically air can be communicated through the cap 336. The connector means here shown is air connector 342 which is here formed with an aperture 344 sized to snugly receive the proximal end 346 of tube 348. An adhesive is preferably provided to ensure there is a secure and air-tight connection between the proximal end 346 and the aperture 344.

The air connector 342 is here shown to be slightly tapered 350 with the exterior 352 slightly smaller than the base 354. The second cap 336 has a hole 356 formed therein sized to snugly receive the air connector 342 therethrough to effect a snug or tight connection at or proximate the base 354 of the air connector 342. As illustrated, the air connector 342 is substantially cylindrical in appearance with the top or exterior 352 and the base 354 both essentially circular in cross section. However, it should be understood that a connector comparable to connector 305 may be interchangeably used as the connector means associated with cap 336.

The air connector 342 has a flange 358 that has an upper surface 360 for mating snugly with the undersurface 366 of the top 364 of the second cap 336. Thus a seal is effected between and by the undersurface 366 and the upper surface 360 of the flange 358. Specifically both are made of materials that can effect the seal such as plastics or plastic-like materials (e.g., nylon, nylon compositions, Teflon®, polyurethane and the like). Of course the flange 358 has an undersurface 360 that mates with the top rim or edge of the spout 334. The undersurface 360 can also deform to effect a seal when the upper rim or edge of the spout 334 has imperfections that would otherwise allow for some leakage. The air connector 342 has an interior channel 368 into which a short extension 370 is optionally connected to present a distal end 372 away from the threads 340.

The tube 348 is made of material similar or identical to that of tube 306 and is sized in length 374 to position a pump means such as pump assembly 376 in a location desired by the user. If the flask is attached, for example, to a backpack, the tube 348 may extend in length 374 so that it may be placed for example over the shoulder, and hang in the vicinity of the belt. Thus, the user could easily grasp and operate the pump assembly 376. Means may be provided to attach the pump assembly 376 to the garments of a user to keep it from moving about and annoying the user while the user is moving (e.g. jogging, hiking, walking, skiing, climbing, biking).

While connectors 305 and 342 are shown to be different in form or shape, it should be understood that they may be used interchangeable if desired.

The pump assembly 376 here shown includes a pump mechanism which is the bulb 378 that connects to a valve structure 380. The valve structure 380 attaches to the distal end 382 of the tube 348. A small piece of tubing 384 is provided made of material similar to the tube 306. It simply functions as an adaptor to accommodate for the differences in size between the tube 348 and the barbed connector 386 of the valve structure. The valve structure 380 has a valve stem 388 that has a top 390 operable by the fingers of a user. The valve stem 388 has a threaded collar 392 that connects to a threaded neck 394 so that the tip 396 can be urged against an internal valve seat in the valve body 398.

The valve structure 380 has another barbed connector 400 with a flange 402. An adaptor 404 is provided that connects to the valve structure with a separate flange 406 to abut the valve structure flange 402. The pump mechanism here shown is a bulb 378 that is movable between a first or at rest position as shown in solid and a compressed or second position 408 shown in dotted line. As the bulb is manipulated between the at rest or first position and the second or compressed position, the nose 410 may deform slightly. That is, the bulb 378 is made of an elastically deformable material that may be rubber or materials similar thereto. As the bulb 378 is manipulated (squeezed) some minor deformation at the nose may occur. The use of a barb connector 400 with two barbs 412 and 414 and the adaptor 404 provides for an effective seal so that air is not lost as the bulb 378 is manipulated.

The inlet end 416 of the bulb 378 has a check valve 418 inserted therein. The check valve has a ball 420 that sealingly seats against a valve seat 422 when pressure is applied as the bulb 378 is moved from the at rest position toward the compressed position 408. A retention structure 424 is provided to hold the ball 420 as the bulb 378 moves to the at rest position drawing air through the check valve 418 into the interior 426 of the bulb 378.

The bulb 378 here shown has a tether 430 with one end 432 secured about the nose 410 of the bulb 378 and with its other end 434 secured about the inlet end 416 of the bulb 378.

The tether may be sized to extend about the torso of a user and be adjustable in length so that the bulb 378 may be placed under the arm of a user. That is, the bulb 378 may be secured by the tether in place so that the arm of user may be moved toward and away from the torso to cause the bulb 378 to move from the first position to the second position 408.

The bulb 378 as illustrated is typically circular in cross section along its length 436. However, for placement under the arm, the bulb 378 may be shaped with a thickness and a width similar to a bar of soap so that it is less protrusive and less likely to interfere with arm movement during periods where the pump is not being used.

In operation, it can be seen that the user would place the valve 380 in an open position by operating the handle 390. Then the bulb 378 is manipulated repetitively to pump air into the interior 310 of the flask 300. The check valve 418 operates to inhibit the movement of air out of assembly when the interior pressure within the interior 426 of the bulb 378 exceeds atmospheric pressure. When the bulb 378 is in the second position 408 and released, a pressure below ambient will draw air from the tube 348 and from exterior the bulb 378 through check valve 418 to fill the bulb 378. The valve 380 can be adjusted to reduce the return of air from the tube 348 and also to seal the tube and retain the air in the flask 300 at the pressure then obtained.

With a pressure in the interior 310 of the flask 300, operation of the bite valve 308 will lead to the release of liquid from the interior through flexible tube 330, connector 305 and flexible tube 306. Thus a user who is exercising may obtain liquid from the flask 300 without having to suck from the bottle or squeeze a bottle or other container which may be difficult during a particular form of exercise.

Those skilled in the art will recognize that reference herein to specific embodiments and other specific details is not intended to limit the scope of the claims which themselves recite those features regarded as essential to the invention.

What is claimed is:

1. A portable flask comprising:

a first panel having a first top, a first bottom and a first perimeter, said first panel being formed of a flexible liquid retaining material, first panel having a first right side and a first left side spaced from said first right side, said first right side and said first left side each extending between said top and said bottom, and said first too having a left section extending angularly away from said first left side and a right section extending angularly away from said first right side and a middle section between said left section and said right section;

a second panel having a second top, a second bottom and a second perimeter, said second panel being formed of a flexible liquid retaining material and being sized to be substantially the same in projection as said first panel said second panel having a second right side and a second left side spaced from said second right side, said second right side and said second left side each extending between said top and said bottom and said second top having a left section extending angularly away from said second left side and a right section extending angularly away from said second right side and a middle section between said left section and said right section;

a perimeter seal formed by joining said first perimeter of said first panel to said second perimeter of said second panel to define a liquid retaining volume;

a first spout having a first base sealed in said perimeter seal, said first base having an aperture formed therein for communicating liquid into and out of said liquid retaining volume, said first base having a first outer surface and a second outer surface spaced from said first outer surface with said first aperture positioned thereinbetween, said first outer surface and said second outer surface each being shaped to intersect each other to form a first tip and a second tip and each of said first outer surface and said second outer surface being configured to be sealed into said perimeter seal between said first perimeter of said first panel and said second perimeter of said second panel proximate the first top of said first panel and the second top of said second panel, and said first spout being positioned proximate said first top and said second ton; and a second spout having a base sealed in said perimeter seal, said second base having an aperture formed therein for communicating liquid into and out of said liquid retaining volume and second snout being positioned proximate said first top and said second top spaced from said first spout.

2. The portable flask of claim 1 wherein said first spout is positioned in said perimeter between said first panel and said second panel in said first section of each of said first top and said second top.

3. The portable flask of claim 2 wherein said second spout is positioned in said perimeter between said first panel and said second panel in said second section of each of said first top and said second top.

4. The portable flask of claim 3 wherein said middle section of said first panel and said second panel has a first leg extending from said first spout to an apex and a second leg extending from said apex to said second spout, said first leg and said second leg being sized in length for effecting a stable seal along said perimeter between said apex and said first spout and said second spout respectively.

5. The portable flask of claim 4 wherein said apex is arcuate with a radius less than the length of one of said first leg and said second leg.

6. The portable flask of claim 4 wherein said first base has a first outer surface and a second outer surface spaced from said first outer surface with said first aperture positioned thereinbetween, said first outer surface and said second outer surface each configured to be sealed into said perimeter seal between said first perimeter of said first panel and said second perimeter of said second panel proximate the first top of said first panel and the second top of said second panel.

7. A portable flask comprising:

a side wall means for defining a liquid retaining volume, said side wall means being formed of a flexible liquid retaining material and said side wall means having at least an upper edge and a lower edge, said side wall means including a first panel having a first right side and a first left side spaced from said first right side, said first right side and said first left side each extending between said upper edge and said lower edge and a second panel having a second right side and a second left side spaced from said second right side, said second right side and said second left side each extending between said upper edge and said lower edge, said first panel having a first top with a left section extending angularly away from said first left side and a right section extending angularly away from said first right side and a middle section between said left section and said right section, and said second panel having a second top with a left section extending angularly away from said second left side and a right section extending angularly away from said second right side and a middle section between said left section and said right section, said middle section of said first panel and said second panel having a first leg extending from said first spout to an apex and a second leg extending from said apex to said second spout, said first leg and said second leg being sized in length for effecting a stable seal along said perimeter between said apex and said first spout and said second spout respectively;

a perimeter seal formed in said upper edge of side wall means and in said lower edge of said side wall means;

a first spout having a first base sealed in said perimeter seal, said first base having a first aperture formed therein for communicating liquid into and out of said liquid retaining volume, said first base having a first outer surface and a second outer surface spaced from said first outer surface with said first aperture positioned thereinbetween, said first outer surface and said second outer surface each configured to be sealed into said perimeter seal proximate said first top and said second top between said first panel and said second panel in said first section of each of said first top and said second top; and a second spout sealed into one of said perimeter seal and said first panel, said second spout having a second aperture for communicating liquid into and out of said liquid retaining volume and positioned proximate said first top and said second top spaced from said first spout in said perimeter seal between said first panel and said second panel in said second section of each of said first top and said second top, and said second spout having a second base sealed in said perimeter seal, said second base having a first outer surface and a second outer surface spaced from said first outer surface with said second aperture positioned thereinbetwcen, said first outer surface and said second outer surface each being configured to be sealed into said perimeter seal.

8. The portable flask of claim 7 wherein said apex is arcuate with a radius less than the length of one of said first leg and said second leg and wherein said perimeter seal is a flat seal having a depth.

9. The portable flask of claim 8 wherein said depth is from about one fourth of an inch to about one inch.

10. The portable flask of claim 7 wherein said second base has a third outer surface and a fourth outer surface spaced from said third outer surface with said second aperture positioned thereinbetween, said third outer surface and said fourth outer surface each configured to be sealed into said perimeter seal between said first perimeter of said first panel and said second perimeter of said second panel proximate the first top of said first panel and the second top of said second panel.

11. The portable flask of claim 10 wherein said first base has a first edge and a second edge with said aperture thereinbetween and with said first outer surface and said second outer surface extending-between said first edge and said second edge.

12. The portable flask of claim 11 wherein said second base has a third edge and a fourth edge with said aperture thereinbetween and with said third outer surface and said fourth outer surface extending between said third edge and said fourth edge.

13. The portable flask of claim 7 further including a first cap sized and configured for sealing removable attachment to said first spout to inhibit the movement of liquids into and out of said liquid retaining volume and a second cap sized and configured for sealing removable attachment to said second spout to inhibit the movement of liquids into and out of said liquid retaining volume.

14. The portable flask of claim 13 wherein said first base has a bottom and a top with said aperture extending between said top and said bottom and wherein said second base has a bottom and a top with said aperture extending between said top and said bottom.

15. The portable flask of claim 7 further including a third panel formed of a flexible liquid retaining material, said third panel being sized to attach to and extend between said first bottom and said second bottom, said third panel being sealed to said first panel and said second panel at said first bottom and said second bottom and upward therefrom along opposite sides of said first panel and said second panel.

16. The portable flask of claim 7 wherein said second spout has a flange sealed to said first panel and wherein said second spout is sized for communicating solids into and out of said liquid retaining volume.

17. The portable flask of claim 6 wherein said second spout is sized for communicating ice cubes into said liquid retaining volume.

18. The portable flask of claim 7 wherein said second spout has a second base sealed in said perimeter seal, said second base having a first outer surface and a second outer surface spaced from said first outer surface with said second aperture positioned thereinbetween, said first outer surface and said second outer surface each being configured to be sealed into said perimeter seal.

19. The portable flask of claim 17 further including a third spout having a third base sealed in said perimeter seal, said third base having a first outer surface and a second outer surface spaced from said first outer surface with a third aperture positioned thereinbetween, said first outer surface and said second outer surface each being configured to be sealed into said perimeter seal.

20. A portable flask comprising:

a first panel having a top, a bottom and a perimeter, said first panel being formed of a flexible liquid retaining material;

a second panel having a top, a bottom and a perimeter, said second panel being formed of a flexible liquid retaining material and being sized to be substantially the same in projection as said first panel;

a perimeter seal formed about the perimeter of said first panel and said perimeter of said second panel joining said perimeter of said first panel to said perimeter of said second panel to define a liquid retaining volume within said perimeter;

a first spout having a base sealed in said perimeter seal, said base of said first spout having an aperture formed therein for communicating liquid between said liquid retaining volume and exterior of said portable flask, said base of said first spout having a first outer surface and a second outer surface spaced from said first outer surface with said first aperture positioned thereinbetween, said first outer surface and said second outer surface each configured to be sealed into said perimeter seal between said perimeter of said first panel and said perimeter of said second panel proximate the top of said first panel and the top of said second panel;

a second spout sealed in one of said first panel and said second panel; and a third spout having a base sealed in said perimeter seal, said base of said third spout having an aperture formed therein for communicating liquid between said liquid retaining volume and exterior of said portable flask, said base of said third spout having a first outer surface and a second outer surface spaced from said first outer surface with said aperture of said third spout positioned thereinbetween, said first outer surface and said second outer surface each configured to be sealed into said perimeter seal between said perimeter of said first panel and said perimeter of said second panel proximate the top of said first panel and the top of said second panel.

21. A portable flask comprising:

a liquid retaining volume including a first side surface and a second side surface each having a top and bottom, said liquid retaining volume being formed of a flexible liquid retaining material, said top having a left section, a right section and a middle section between said left section and said right section, said left section extending angularly toward said middle section and said right section extending angularly toward said middle section;

a perimeter seal to retain liquid in said liquid retaining volume, said perimeter seal including said top and said bottom, said perimeter defining a said liquid retaining volume;

a first spout positioned proximate said top and having a first base sealed in one of said left section and said right section of said top, said first base with a first aperture formed therein for communicating liquid into and out of said liquid retaining volume, said first base having a first outer surface and a second outer surface spaced from said first outer surface with said first aperture positioned thereinbetween, said first outer surface and said second outer surface each being shaped to intersect each other to form a first tip and a second tip and each of said first outer surface and said second outer surface being configured to be sealed into one of said top portion and said bottom portion of said perimeter seal;

a second spout sealed in one of the other of said left section, said right section and in said bottom portion, said first side surface and said second side surface; and a third spout sealed in another of said left section, said right section and in said bottom portion, said first side surface and said second side surface.

* * * * *